United States Patent [19]

Gonzalez

[11] Patent Number: 4,463,220

[45] Date of Patent: Jul. 31, 1984

[54] DRILL BIT FOR FORMING A FLUID CUSHION BETWEEN THE SIDE OF THE DRILL BIT AND THE SIDE WALL OF A BORE HOLE

[76] Inventor: Eduardo B. Gonzalez, Ave. Universidad Num. 482, Mexico 13, D.F., Mexico

[21] Appl. No.: 267,794

[22] Filed: May 28, 1981

[51] Int. Cl.[3] ..... E21B 10/18; E21B 10/60

[52] U.S. Cl. ..... 175/343; 175/340; 175/393; 175/322

[58] Field of Search ..... 175/228, 322, 393, 340, 175/231, 324, 339, 422

[56] References Cited

U.S. PATENT DOCUMENTS

| | | | |
|---|---|---|---|
| 2,710,741 | 6/1955 | Hall | 175/340 |
| 2,805,045 | 9/1957 | Goodwin | 175/340 |
| 3,645,396 | 2/1972 | Miller et al. | 175/393 |
| 4,154,312 | 5/1979 | Barnetche | 175/228 |

*Primary Examiner*—Stephen J. Novosad
*Assistant Examiner*—William P. Neuder
*Attorney, Agent, or Firm*—Armstrong, Nikaido, Marmelstein & Kubovcik

[57] ABSTRACT

In a drill bit comprising a body having a channel therethrough for carrying drilling fluid for injection into a bore hole through a nozzle at one end thereof and a cutting head mounted in the body and contacting the bottom of the bore hole. The improvement comprises at least one passage extending from the channel to a side portion of the exterior surface of the body wherein drilling fluid in the channel will flow through the at least one passage to the exterior of the body and form a fluid layer between the side portion of the body and the opposing side of the bore hole.

4 Claims, 8 Drawing Figures

DRILL BIT FOR FORMING A FLUID CUSHION BETWEEN THE SIDE OF THE DRILL BIT AND THE SIDE WALL OF A BORE HOLE

BACKGROUND OF THE INVENTION

1. Field of the Invention

The present invention is directed to a drill bit and, more particularly, to a drill bit which includes passages for carrying drilling fluid to the exterior sides of the drill bit for forming a fluid layer between exterior side portions of the drill bit and the side wall of a bore hole.

2. Description of the Prior Art

In prior art downhole devices such as drill bits, there is generally some contact between the sides of the downhole device and the sides of the borehole. The contact between the device and the side of the borehole causes friction which results in the wearing of that portion of the downhole device which contacts the side of the bore hole.

One example of a typical prior art downhole device which has contact between the side of the device and the side of the borehole is a drill bit with a single conical cutter head such as that shown in U.S. Pat. No. 4,154,312 and by co-pending application Ser. No. 153,683, filed May 27, 1980, both of which are incorporated herein by reference. In the single conical cutter head of the type shown, the drilling action of the bit produces a force which pushes side portions of the bit against the side wall of the borehole, which produces a lateral reaction force. The lateral force tends to drive the bit body to turn eccentrically in the direction diametrically opposite to the line of radial contact of the conical head with the well bottom. The lateral force causes friction and results in wear on that portion of the bit body.

Furthermore, in drill bits of this type, in order to make the drill bit turn on its true geometric axis, it has been necessary to use a stabilizer or centralizer. The stabilizer is generally made of a very hard material in order to reduce wear and prolong its life. The need for the stabilizers and the necessity for making the stabilizer of a hard material significantly increases the cost of the drill bit and, although increasing the life of the drill bit as compared to one without a stabilizer or without some type of hard material to reduce wear, these types of prior art devices are still subject to wear and, therefore, required fairly frequent replacement.

In considering the use of drill bits such as those described, namely, for drilling in the earth's crust for oil, water or minerals, the environment is very hostile to the drill bit. Thus, the drill bit is subject to extreme wear. Furthermore, especially when drilling for oil, the depth of the drill string is extremely long as, for example, in the area of 5,000 to 10,000 feet. Thus, the raising of the drill string to replace the drill bit requires a great deal of time and is, therefore, very expensive because during this time period, no drilling can take place.

SUMMARY OF THE INVENTION

It is the primary object of the present invention to provide an improvement in a downhole device, such as a drill bit, in which a fluid layer is formed between side portions of the drill bit and the side wall of the bore hole to thereby eliminate contact between the side portion of the drill bit and the side wall of the borehole which results in the elimination of friction and thus the elimination of wear of the side portion of the drill bit.

It is another object of the present invention to provide passages extending from a channel formed in the drill bit for carrying drilling fluid into the borehole wherein drilling fluid flows through the passages from the channel to the exterior of the drill bit at the side portions thereof to form the fluid layers.

It is a still further object of the present invention to form a fluid layer between the side portions of a drill bit body and the side of the borehole in an area which is diametrically opposed to the line of radial contact between the cutting head and the bottom of the borehole.

It is still another object of the present invention to provide a drill bit which has stabilizers which form side portions of the drill bit body for maintaining proper alignment of the geometric axis of the drill bit wherein the stabilizers include passages for carrying drilling fluid to the exterior side portions thereof, to form a fluid layer between the exterior side portions thereof and the side walls of the bore hole.

The present invention is directed to an improvement in a drill bit comprising a body having a channel therethrough for carrying drilling fluid for injection into a bore hole through a nozzle at one end thereof. A cutting head is mounted in the body and contacts the bottom of the borehole. The improvement comprises at least one passage which extends from the channel to a side portion of the exterior surface of the drill bit body wherein the drilling fluid in the channel will flow through at least one passage to the exterior of the body and form a fluid layer between the side portion of the body and the side of the bore hole. The side portion of the exterior surface of the body to which the fluid flows is positioned on the opposite side of the body from the side in which the cutting head contacts the bottom of the bore hole. Still another feature of the present invention is that the side portion of the body includes a stabilizer and the passages extend from the channel carrying the drilling fluid to the exterior of the stabilizer structure and the fluid layer is formed between the sides of the stabilizer structure and the side of the bore hole.

DETAILED DESCRIPTION OF THE PREFERRED EMBODIMENTS

Figure 1:
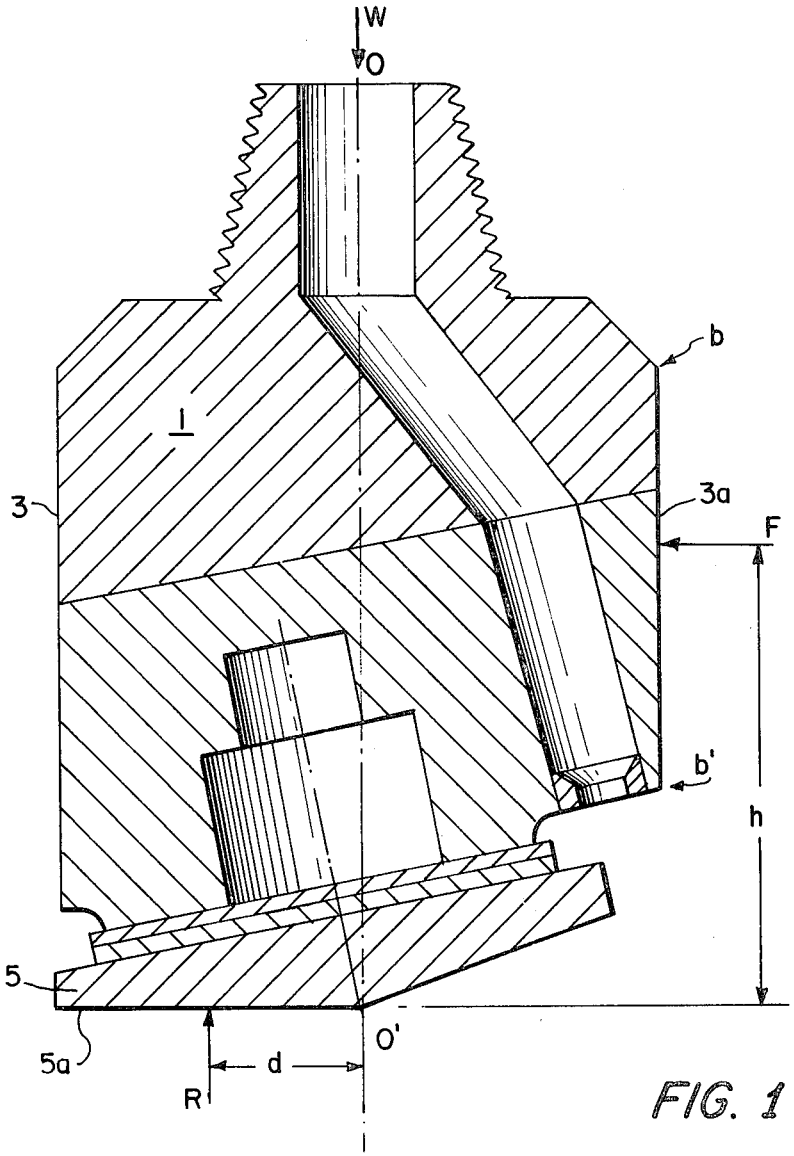
FIG. 1 is a drill bit of the single conical cutter head type, which shows the various forces on the drill bit.
Figure 6:
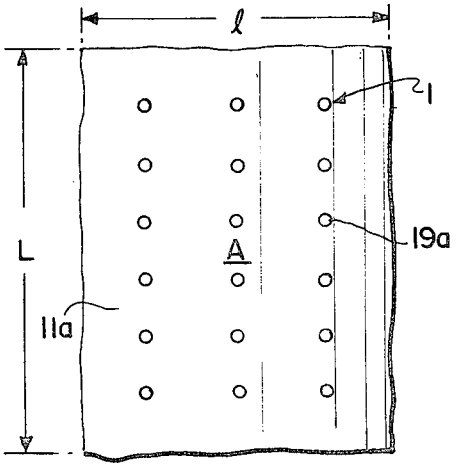
FIG. 6 is an elevation view of the side portion shown in FIG. 4.

Referring to FIG. 1, a drill bit 1 has a body 3 and a conical cutting head 5. When the drill bit is rotating in a borehole and the portion 5*a* of the cutting head 5 is in contact with the bottom of the borehole, a mechanical equilibrium is created between the reaction force R located at a distance "d" from the axis O-O' and the reaction force "F" on the side portion 3*a* of the body 3 which is located at a vertical distance "h" from the horizontal contacting portion of the cutting head 5a. The reaction force F is distributed along the entire lateral or side contact surface "bb'" of the side portion of the body 3. However, for analysis purposes, these forces can be shown as a single force located at the center of portion 5a and the center of the portion 3a.

Equilibrium is obtained when:

$$R \times d = F \times h,$$

thus $$R/F = h/d$$

In general, the distance "d" is small when compared to the height "h".

In the prior art, one technique used for reducing the reaction force "F" is to increase the height "h" by the addition of stabilizers at the top of the body 3. Another prior art technique for reducing wear caused by friction is to form a stabilizer pad of a hard metal at portion 3a of the body.

Figure 2:
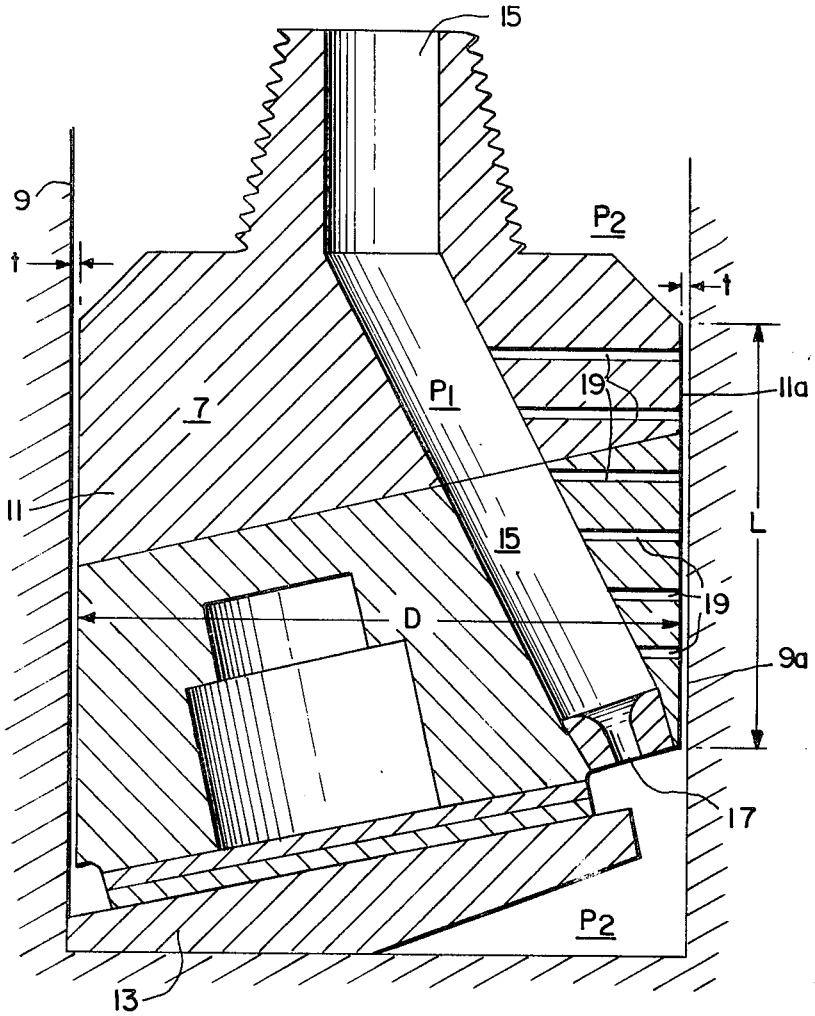
FIG. 2 is a side view of a preferred embodiment of the present invention.
Figure 3:
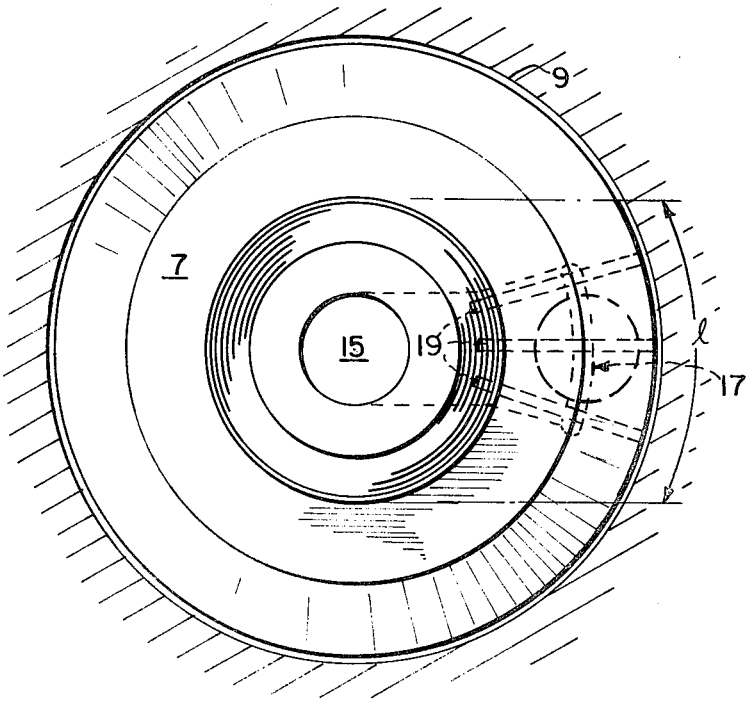
FIG. 3 is a top view thereof.

FIGS. 2–6 illustrate a preferred embodiment of the present invention. In FIGS. 2 and 3, a drill bit is positioned within a borehole 9. The drill bit 7 has a body 11 and a cutting head 13. A channel 15 having a nozzle 17 at one end thereof carries drilling fluid such as mud, which is pumped from the surface, through the drill string and injects the drilling fluid into the bottom of the borehole 9 through nozzle 17.

A plurality of passages 19 extend from the channel 15 to the side portion 11a of the body 11, the passages opening into the borehole 9. The plurality of passages 19 are located in an area which is bounded by the vertical distance "L" and the circumferential distance "l" which is the portion 11a of the side of the body 11 which contacts the side 9a of the borehole 9. The area of contact between the side portion of the body 11a and the side of the borehole 9a is:

$$A = L \times l$$

Figure 4:
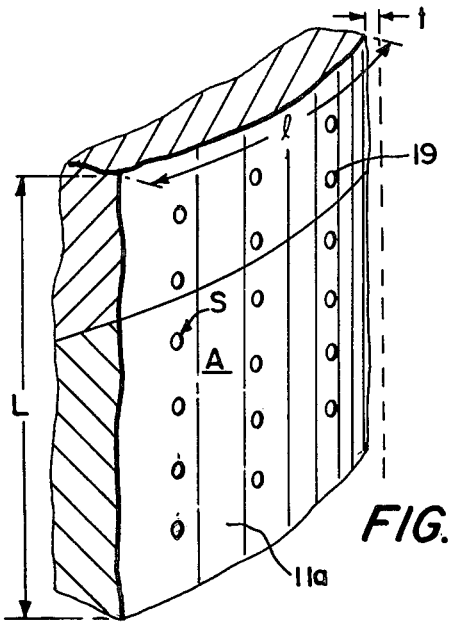
FIG. 4 is a perspective view of a side portion of a drill bit of the present invention.
Figure 5:
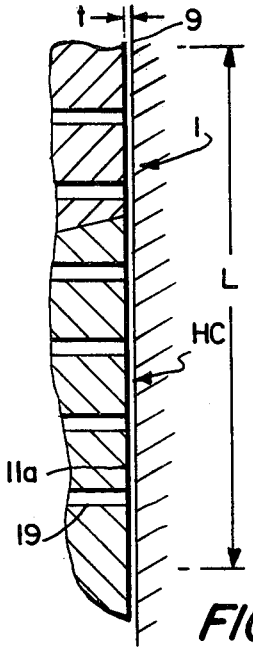
FIG. 5 is a sectional view through line V—V in FIG. 4.

FIG. 4 illustrates the positioning of the openings 19a of the passages 19 on the side portion 11a of the body 11.

During normal drilling operations, drilling fluid flows through the channel 15 at a pressure $P_1$ and is injected into the bottom of the borehole at a very large velocity through nozzle 17. The nozzle 17 has a very small cross-section in comparison to the cross-section of the channel 15. The choking action of the nozzle results in a large pressure differential between the pressure $P_1$ in the channel 15 and the pressure $P_2$ in the bottom of the borehole. This pressure differential creates the large velocity through the nozzle 17 which is in the range of 200–500 feet per second which produces the required hydraulic impact for cleaning of the well bottom and the teeth in the cutting head. Typically the pressure differential is in the range of 200–800 psi and water flow is in the range of 300–600 gpm.

The flow through the passages 19 by comparison is very small and thus is very convenient to provide a balancing of forces acting on the drill bit body during a drilling operation.

The drilling fluid passing through the passages 19 creates a small layer of fluid on the peripheral surface of side portion 11a of the drill bit body. The fluid layer which extends between the side portion of the body 11a and the side 9a of the borehole 9 has a thickness "t".

If the cross-sectional area of each of the openings 19a of the passage 19 has a cross-sectional area "s" and if there are "n" number of openings 19a, then:

$$S = ns$$

and the quantity of drilling fluid passing through one channel 19 is:

$$q = Vs,$$

where V is the velocity of the fluid;

and the total quantity of drilling fluid passing through all of the channels 19 is:

$$Q = VS$$

The drilling fluid which escapes through the area between the edges of the side portion 11a and the side 9a of the borehole is a function of the cross-sectional area of the peripheral opening and is:

$$S_P = L_P \times t,$$

where:

$$L_P = 2(L + l)$$

If the area of the peripheral opening is less than the total cross-sectional area of the openings 19a, that is:

$$ns > (L_P \times t);$$

or $$S > S_P$$

then the pressure of the film of fluid between the side portion 11a and the side of the bore hole 9a will be very close to the differential pressure $P_1$–$P_2$ and when "t" is approximately 0, the pressure will be:

$$P_h = P_1 - P_2.$$

In this case, the hydraulic force against the side of the borehole will be:

$$F_h = (P_1 - P_2)A.$$

This equation represents the maximum hydraulic lateral force which can be obtained.

If the thickness "t" is such that the area $S_P$ is larger than the total area S of the openings 19a, then the pressure of the film will be smaller than the differential pressure, that is:

$$P_h < (P_1 - P_2) \text{ and}$$

$$F_h < (P_1 - P_2)A$$

In practice, the thickness "t" will automatically adjust itself such that the lateral force $F_h$ will be such that a fluid layer is formed between the side portion of the drill bit body and the side of the borehole so that the side portion of the drill bit body does not contact the side of the borehole except in response to instantaneous jerking movement of the drill bit. The fluid layer acts as a hydraulic cushion and substantially reduces the mechanical friction acting on the side portion of the drill bit body.

Another advantage which is derived from the present invention is that the cuttings, sand or rock detritus in the borehole does not come into contact with the side portion of the drill bit body because there is a positive flow of drilling fluid outward through the thickness "t".

The principle of the present invention can be applied to any type of device positioned anywhere in the drill string, including devices above the drill bit.

Figure 7:
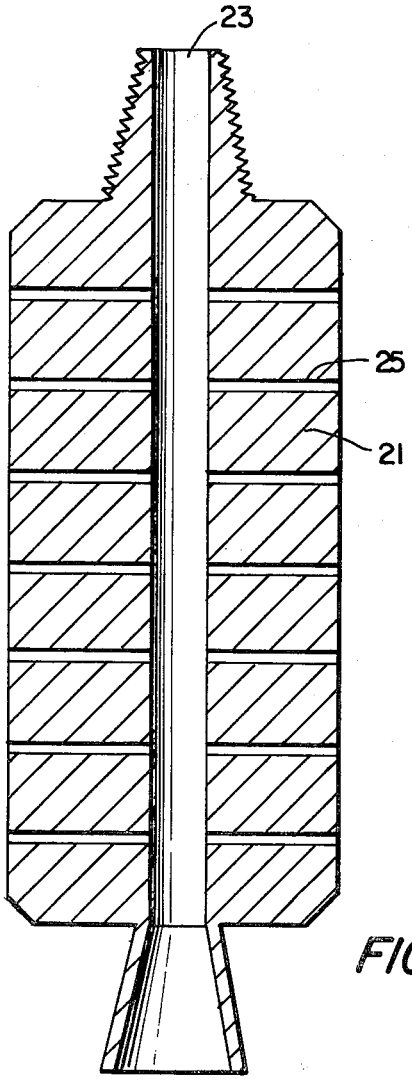
FIG. 7 is a sectional view of another embodiment of the present invention.
Figure 8:
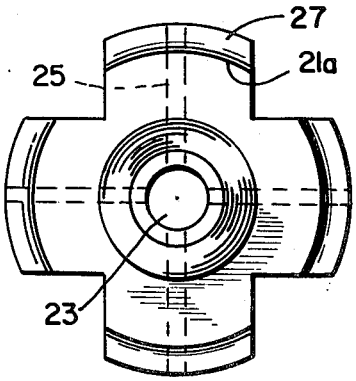
FIG. 8 is a top view of the device shown in FIG. 7.

FIGS. 7 and 8 illustrate a stabilizer which is typically used in a drill string above the drill bit to stabilize the rotation of the drill string. The stabilizer illustrated in FIGS. 7 and 8 is a four-blade stabilizer which has a body 21 having a channel 23 passing therethrough which carries the drilling fluid down the drill string. A plurality of passages 25 extend from the channel 23 to the exterior side of the stabilizer. Drilling fluid passes through the passages 25 to form a thin layer 27 on the exterior side portions 21*a* of the stabilizer body. The fluid layer 27 forms a cushion between the side portion 21*a* and the side of the borehole.

The principle of the present invention is also applicable to other drilling fluids, such as air, gas, etc. The use of a different drilling fluid merely requires a variation in some of the other parameters but, in principle, the operation is the same.

The present invention may be embodied in other specific forms without departing from the spirit or essential characteristics thereof. The presently disclosed embodiments are, therefore, to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed:

1. In a drill bit comprising a body having a channel therethrough for carrying drilling fluid for injection into a borehole through a nozzle at one end thereof and a cutting head mounted in said body and contacting the bottom of the borehole; the improvement comprising at least one passage extending from said channel to a side portion of the exterior surface of said body, said side portion of the exterior surface of said body being positioned on the opposite side of the body from the side in which said cutting head contacts the bottom of the borehole wherein drilling fluid in said channel will flow through said at least one passage to the exterior of said body and form a fluid layer between the side portion of said body and the opposing side of the borehole thereby providing a hydraulic cushion therebetween such that contact between said side portion of said body and the opposing side of said borehole, as a result of the reaction force of the cutting head and bottom of the borehole, is substantially eliminated.

2. A drill bit as set forth in claim 1 wherein said at least one passage is a plurality of passages.

3. A drill bit as set forth in claim 1 wherein said cutting head is a single conical cutting head and the circumferential center of said side portion is diametrically opposite the line of radial contact of said cutting head.

4. A drill bit as set forth in any one of claims 1, 2 or 3 wherein said side portion includes a stabilizer means and wherein said passages extend to the exterior of said stabilizer means.

* * * * *

UNITED STATES PATENT AND TRADEMARK OFFICE

CERTIFICATE OF CORRECTION

PATENT NO. : 4,463,220

DATED : July 31, 1984

INVENTOR(S) : EDUARDO BARNETCHE GONZALEZ

It is certified that error appears in the above-identified patent and that said Letters Patent is hereby corrected as shown below:

On the cover page, Item [76], change "Eduardo B. Gonzalez" to --- Eduardo Barnetche Gonzalez ---.

Signed and Sealed this

*Twenty-third* Day of *April 1985*

[SEAL]

*Attest:*

DONALD J. QUIGG

*Attesting Officer* *Acting Commissioner of Patents and Trademarks*